US006513411B2

(12) United States Patent
Shang

(10) Patent No.: US 6,513,411 B2
(45) Date of Patent: Feb. 4, 2003

(54) DIE BLOCK ASSEMBLY WITH CLEARANCE PROTECTION MECHANISM

(75) Inventor: Yu Liu Shang, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/745,540

(22) Filed: Dec. 20, 2000

(65) Prior Publication Data

US 2002/0073817 A1 Jun. 20, 2002

(51) Int. Cl.[7] ..... B26D 7/06

(52) U.S. Cl. ..... 83/143; 83/129; 83/134; 83/140; 83/142; 83/143

(58) Field of Search ..... 83/129–146, 651

(56) References Cited

U.S. PATENT DOCUMENTS 3,797,342 A * 3/1974 Sekel ..... 83/55
3,848,496 A * 11/1974 Stevens et al. ..... 83/133
5,176,057 A * 1/1993 Chun et al. ..... 83/139
5,253,559 A * 10/1993 Philippe et al. ..... 83/133
5,722,280 A * 3/1998 Bodnar ..... 72/186
5,836,226 A * 11/1998 Tsuji et al. ..... 83/129

* cited by examiner

*Primary Examiner*—Allan N. Shoap
*Assistant Examiner*—Isaac Hamilton
(74) *Attorney, Agent, or Firm*—WeiTe Chung

(57) ABSTRACT

A die block assembly of the present invention includes an upper die (20), an unloading plate (40), a plurality of springs (60), and a plurality of spacer blocks (80). A plurality of receiving holes (30) is defined in the upper die, for receiving the springs. A plurality of rams (34) depends from the upper die, for stamping a workpiece (95). The unloading plate is movably connected under the upper die, and defines a plurality of through holes (42) for accommodating the corresponding rams therein. Each spacer block is a stepped cylinder which includes a base (82) and a protrusion (84) extending upwardly from the base. Each spring abuts the base of the corresponding spacer blocker. A height of each base is slightly greater than a maximize clearance between the upper die and the unloading plate. The spacer blocks prevent spring fragments produced in the stamping process from entering the clearance.

12 Claims, 2 Drawing Sheets

DIE BLOCK ASSEMBLY WITH CLEARANCE PROTECTION MECHANISM

BACKGROUND

1. Field of the Invention

The present invention relates to a die block assembly, and particularly to a die block assembly which prevents spring fragments from entering a clearance of the assembly.

2. The Related Art

In industrial stamping processes, a ram of a die block assembly often sticks to a stamped workpiece. To overcome this problem, auxiliary unloading structures have been developed for die block assemblies.

A conventional die block assembly is shown in FIG. 2. An upper die 100 of the die block assembly includes a fixing plate 102, an intermediate plate 104 and a clamping plate 106. The plates 102, 104, 106 are stacked and secured together using a plurality of upper bolts (not labeled). A plurality of receiving holes 108 (only one shown) is defined through the intermediate plate 104 and the clamping plate 106. Each hole 108 receives a spring 112. A plurality of rams 110 (only one shown) depends from a bottom surface of the clamping plate 106, for stamping a workpiece 150. An unloading plate 120 is connected to the clamping plate 106. A plurality of lower bolts 140 (only one shown) extends through corresponding bores (not labeled) of the clamping plate 106 to engage with the unloading plate 120, thereby connecting the clamping plate 106 to the unloading plate 120. The clamping plate 106 can move up and down around perimeters of the bolts 140. A plurality of through holes 122 (only one shown) is defined in the unloading plate 120, for receiving the corresponding rams 110 of the clamping plate 106.

In the stamping process, the upper die 100 moves downwardly so that the clamping plate 106 touches the unloading plate 120. The springs 112 are compressed, and the ram 110 completes stamping of the workpiece 150. When the upper die 100 moves back upwardly, the springs 112 return to their original position and abut against the unloading plate 120, thereby preventing the unloading plate 120 from moving upwardly. The rams 110 move upwardly relative to the unloading plate 120, and exit the workpiece 150. Thus the workpiece 150 is prevented from sticking to the rams 110.

The springs 112 used in the die block assembly tend to age and deform permanently over time. Eventually the springs fracture, producing very hard fragments 114 (only one shown). When the die block assembly vibrates, the fragments 114 are prone to enter a clearance between the clamping plate 106 and the unloading plate 120. Thus in subsequent stamping, the die block assembly is easily deformed or even fractured.

Therefore an improved die block assembly is needed to overcome the above-mentioned shortcomings of the prior art.

SUMMARY OF THE INVENTION

Accordingly, an object of the present invention is to provide a die block assembly which prevents damage being caused by spring fragments produced from springs thereof.

To achieve the above-mentioned object, a die block assembly of the present invention comprises an upper die, an unloading plate, a plurality of springs, and a plurality of spacer blocks. A plurality of receiving holes is defined in the upper die, for receiving the springs. A plurality of rams depends from the upper die, for stamping a workpiece. The unloading plate is movably connected under the upper die, and defines a plurality of through holes for accommodating the corresponding rams therein. Each spacer block is a stepped cylinder which comprises a base and a protrusion extending upwardly from the base. Each spring abuts against the base of the corresponding spacer block. A height of each base is slightly greater than a maximum clearance between the upper die and the unloading plate. The spacer block prevents spring fragments produced in the stamping process from entering the clearance.

Other objects, advantages and novel features of the present invention will be drawn from the. following detailed embodiment of the present invention with attached drawings, in which:

DESCRIPTION OF THE PREFERRED EMBODIMENT

Figure 1:
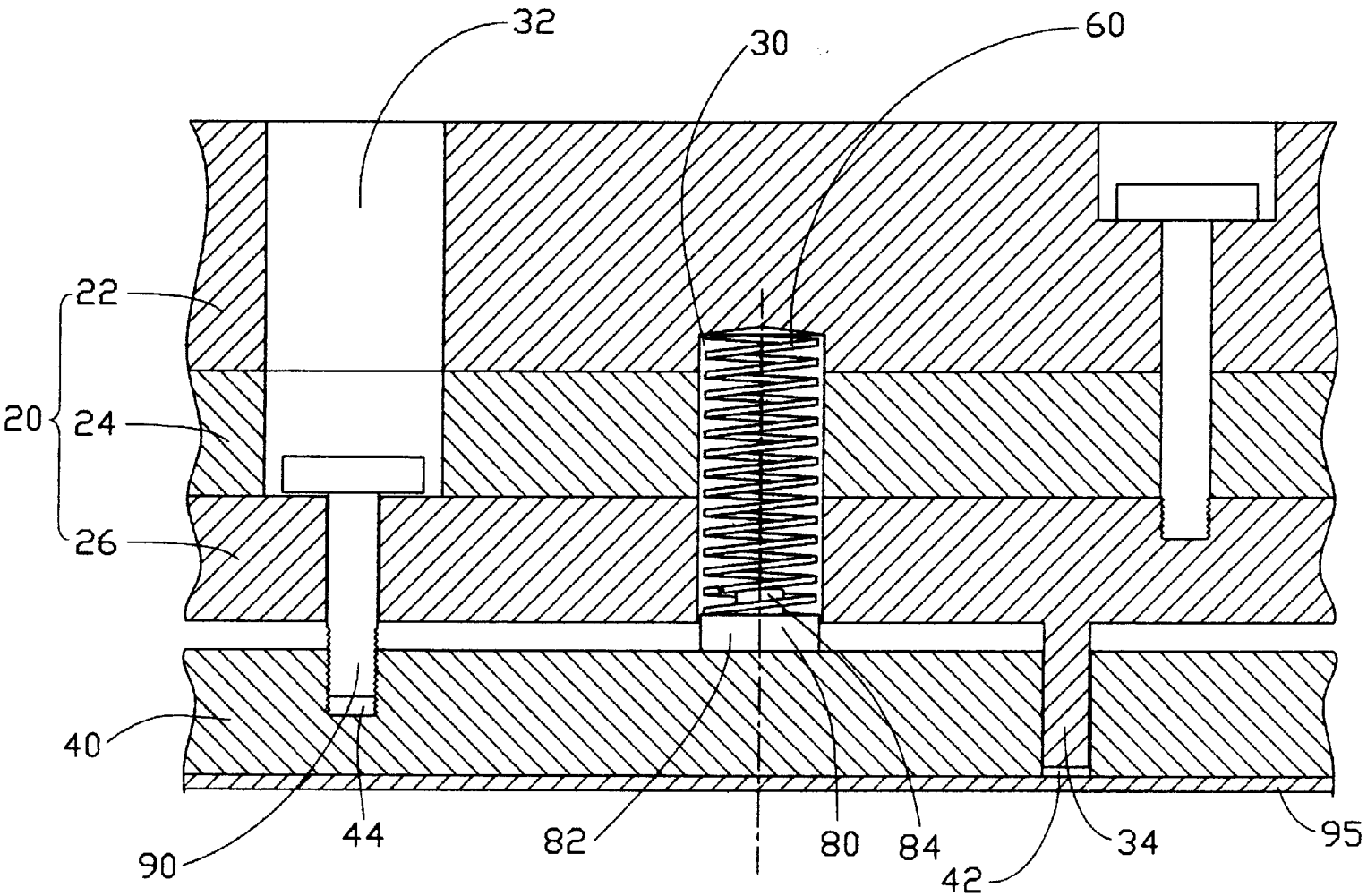
FIG. 1 is a schematic cross-sectional view of a die block assembly of the present invention.
Figure 2:
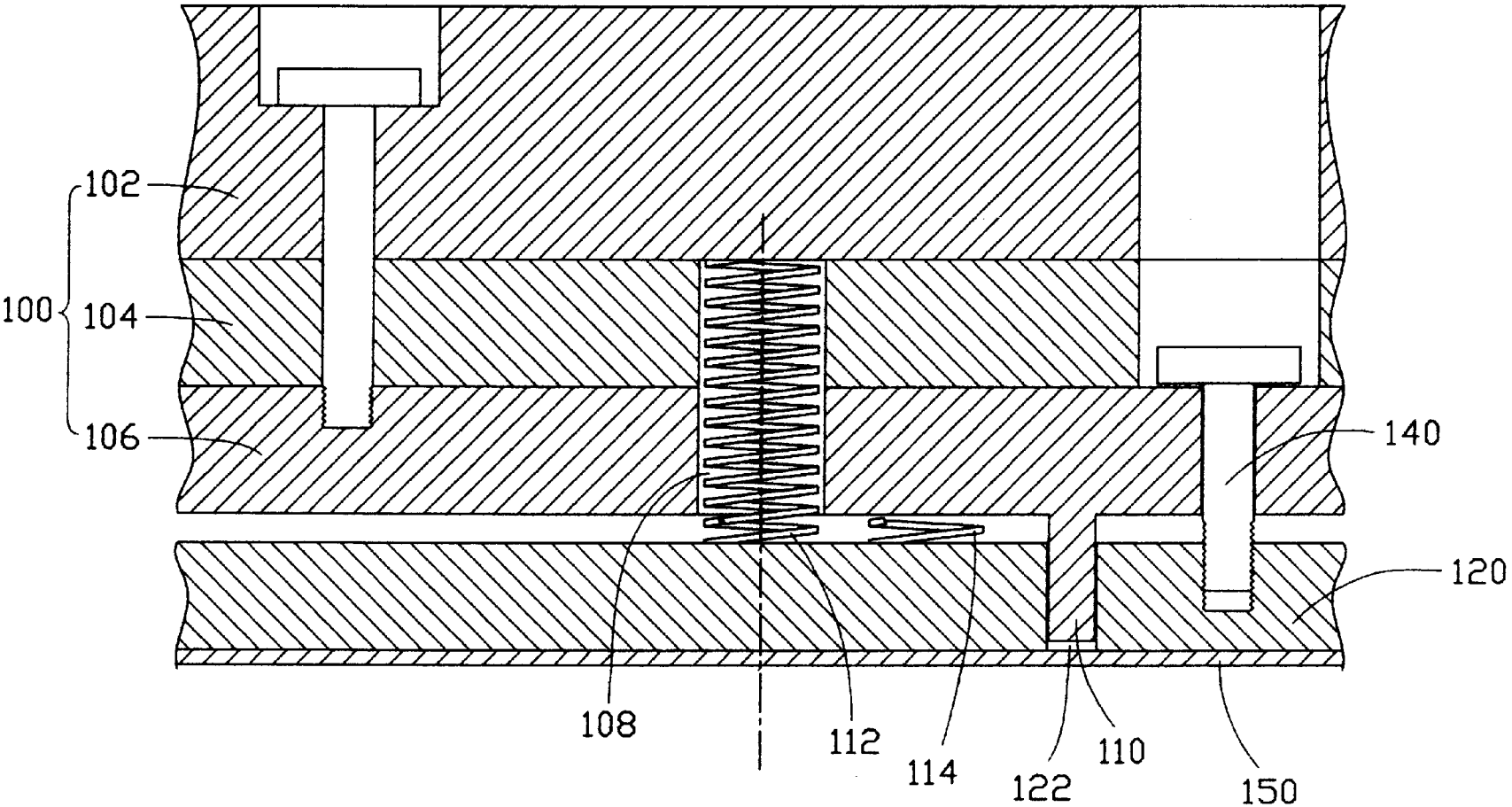
FIG. 2 (PRIOR ART)
FIG. 2 is a schematic cross-sectional view of a conventional die block assembly.

Referring to FIG. 1, a die block assembly in accordance with the present invention is used for stamping a workpiece 95. The die block assembly includes an upper die 20, an unloading plate 40, a plurality of springs 60 (only one shown) and a plurality of spacer blocks 80 (only one shown).

The upper die 20 includes a fixing plate 22, an intermediate plate 24, and a clamping plate 26. Using a plurality of first bolts (not shown), the fixing plate 22 is fixed to the intermediate plate 24, and the intermediate plate 24 is fixed to the clamping plate 26. A plurality of receiving holes 30 (only one shown) is defined in the upper die 20. Each receiving hole 30 extends through the clamping plate 26 and the intermediate plate 24, and then extends into the fixing plate 22 of the upper die 20. A spring 30 is received in each receiving hole 30. A plurality of bores 32 (only one shown) is defined through the fixing plate 22, the intermediate plate 24 and the clamping plate 26. A diameter of a lower portion of each bore 32 which is within the clamping plate 26 is less than a diameter of an upper portion of each bore 32 which is within the fixing plate 22 and the intermediate plate 24. A plurality of rams 34 (only one shown) depends from a bottom surface of the clamping plate 26.

The unloading plate 40 defines a plurality of through holes 42 (only one shown) therethrough, corresponding to the rams 34 of the clamping plate 26. A plurality of screw holes 44 (only one shown) is defined in the unloading plate 40, for receiving corresponding second bolts 90. A diameter of each second bolt 90 is slightly less than a diameter of the bore 32 of the clamping plate 26, so that the clamping plate 26 can move vertically along a length of each second bolt 90 between a cap (not labeled) of each second bolt 90 and a top surface of the unloading plate 40.

Each spacer block 80 is a stepped cylinder, and includes a base 82 and a protrusion 84. The protrusion 84 extends upwardly from a center of a top surface of the base 82. A height of the base 82 is slightly greater than a maximum clearance height between the clamping plate 26 and the unloading plate 40. A diameter of the base 82 is slightly less than a diameter of the receiving hole 30, and slightly greater than an external 25 diameter of the spring 60. A diameter of the protrusion 84 is less than an inside diameter of the spring 60.

In assembly, the rams 34 of the clamping plate 26 enter the corresponding through holes 42 of the unloading plate 40. The second bolts 90 are inserted into the bores 32 of the clamping plate 26 and engaged in the screw holes 44 of the unloading plate 40, thereby attaching the clamping plate 26 to the unloading plate 40. A tool (not shown) is used to adjust engaging length between the second bolts 90 and the unloading plate 40, so that the maximum clearance height between the clamping plate 26 and the unloading plate 40 is slightly less than the height of the base 82 of the spacer block 80.

The intermediate plate 24 is placed on the clamping plate 26, with the corresponding receiving holes 30 thereof axially aligning with each other. One spacer block 80 and one spring 60 are inserted into each receiving hole 30. Each spring 60 abuts against the base 82 of the corresponding spacer block 80, and receives the protrusion 84 of the spacer block 80 therein. The fixing plate 22 is placed on the intermediate plate 24, with portions of the receiving holes 30 and the bores 32 of the fixing plate 22 aligning with corresponding portions of the receiving holes 30 and bores 32 of the intermediate plate 24. A plurality of first bolts (not shown) fixes the fixing plate 22, the intermediate plate 24 and the clamping plate 26 together. Then the second bolts 90 are further adjusted so that the springs are slightly compressed. Thus the unloading plate 40 is vertically movable relative to the upper die 20.

The spacer blocks 80 in the receiving holes 30 prevent spring fragments which may be produced in the stamping process from falling into the clearance between the clamping plate 26 and the unloading plate 40. This prevents the die block assembly from being damaged by spring fragments.

It is understood that the invention may be embodied in other forms without departing from the spirit thereof. Thus, the present example and embodiment are to be considered in all respects illustrative and not restrictive, and the invention is not to be limited to the details given herein.

What is claimed is:

1. A die block assembly comprising:

an upper die including at least one receiving hole defined therein and at least one ram depending therefrom;

at least one spring, each spring being received in the corresponding receiving hole;

an unloading plate connected under the upper die and vertically movable relative to the upper die, the unloading plate defining at least one through hole, each through hole accommodating the corresponding ram of the upper die; and at least one block, each block positioned on the unloading plate and in alignment with the corresponding receiving hole, a height of each block being slightly greater than a maximum clearance between the upper die and the unloading plate, wherein the at least one spring is positioned upon the corresponding block and is entirely located in the corresponding receiving hole.

2. The die block assembly as described in claim 1, wherein the upper die comprises a fixing plate, an intermediate plate, and a clamping plate.

3. The die block assembly as described in claim 2, wherein the fixing plate, the intermediate plate and the clamping plate are stacked and fixed together by at least one first bolt.

4. The die block assembly as described in claim 2, wherein the fixing plate abuts against the intermediate plate, and the at least one receiving hole is defined through the clamping plate and the intermediate plate and partially through the abutting fixing plate.

5. The die block assembly as described in claim 1, wherein each block is a stepped cylinder including a base and a protrusion extending upwardly from the base, and wherein a height of each base is slightly greater than the maximum clearance between the upper die and the unloading plate.

6. The die block assembly as described in claim 5, wherein a diameter of the base of each block is slightly greater than an external diameter of the corresponding spring.

7. The die block assembly as described in claim 5, wherein a diameter of the protrusion of each block is less than an inside diameter of the corresponding spring.

8. The die block assembly as described in claim 1, wherein the upper die is connected to the unloading plate by at least one second bolt, and wherein each second bolt engages with the unloading plate such that the upper die can move vertically along a length of each bolt.

9. A die block assembly comprising:

an upper die including at least one receiving hole defined therein and at least one ram depending therefrom;

at least one spring, each spring being received in the corresponding receiving hole of the upper die;

an unloading plate connected under the upper die and vertically movable relative to the upper die, the unloading plate defining at least one through hole, each through hole accommodating the corresponding ram of the upper die; and blocking means for preventing fragments produced by the spring from entering a clearance between the upper die and the unloading plate, wherein the blocking means is positioned on the unloading plate, and partly received in the at least one receiving hole when the upper die is farthest from the unloading plate; and the spring is positioned on the blocking means and is entirely located in the least one receiving hole.

10. The die block assembly as described in claim 9, wherein the blocking means includes at least one block abutting against the corresponding spring and the unloading plate.

11. The die block assembly as described in claim 10, wherein each block is a stepped cylinder including a base and a protrusion extending upwardly from the base, and a height of each base is slightly greater than a maximum clearance between the upper die and. the unloading plate, thereby preventing the fragments from entering the clearance.

12. A die block assembly comprising:

an upper plate including an upper fixing plate, an intermediate plate and a lower clamping plate stacked with one another;

a receiving hole extending through both said intermediate and clamping plate with one end terminating in the fixing plate and the other end terminating on a bottom surface of the clamping plate;

an unloading plate under said clamping plate;

a clearance between the upper die and the unloading plate;

a spring entirely, constantly disposed in said receiving hole;

a workpiece located under the unloading plate; and a spacer block located on said clamping plate and in alignment with said receiving hole; wherein said spacer block includes a base with an upper portion constantly received in said receiving hole, and one end of the spring seated on said upper portion and the other end of the spring received in said fixing plate.

* * * * *